US010166792B2

(12) United States Patent
Weingartner

(10) Patent No.: US 10,166,792 B2
(45) Date of Patent: Jan. 1, 2019

(54) METHOD FOR REDUCING BANDING EFFECTS

(71) Applicant: Durst Phototechnik Digital Technology GmbH, Lienz (AT)

(72) Inventor: Peter Weingartner, Dolsach (AT)

(73) Assignee: DURST PHOTOTECHNIK DIGITAL TECHNOLOGY GMBH, Lienz (AT)

( * ) Notice: Subject to any disclaimer, the term of this patent is extended or adjusted under 35 U.S.C. 154(b) by 0 days.

(21) Appl. No.: 14/897,729

(22) PCT Filed: May 4, 2015

(86) PCT No.: PCT/EP2015/000904
§ 371 (c)(1),
(2) Date: Dec. 11, 2015

(87) PCT Pub. No.: WO2015/172867
PCT Pub. Date: Nov. 19, 2015

(65) Prior Publication Data

US 2016/0107460 A1 Apr. 21, 2016

(30) Foreign Application Priority Data

May 16, 2014 (DE) ..... 10 2014 007 131

(51) Int. Cl.
*B41J 11/02* (2006.01)
*B41J 13/00* (2006.01)
(Continued)

(52) U.S. Cl.
CPC ..... *B41J 13/0009* (2013.01); *B41J 11/002* (2013.01); *B41J 11/0015* (2013.01);
(Continued)

(58) Field of Classification Search
CPC ..... C09D 11/101
(Continued)

(56) References Cited

U.S. PATENT DOCUMENTS 6,550,905 B1 * 4/2003 Deckers ..... C09D 11/101 347/100
7,393,095 B2 * 7/2008 Oshima ..... B41J 11/002 347/101
(Continued)

FOREIGN PATENT DOCUMENTS

WO 2013/006158 A1 1/2013

OTHER PUBLICATIONS

International Search Report for PCT/EP2015/000904 dated Aug. 12, 2015.

*Primary Examiner* — Matthew Luu
*Assistant Examiner* — Lily Kemathe
(74) *Attorney, Agent, or Firm* — Pearne & Gordon LLP

(57) ABSTRACT

Method for reducing banding effects in images, in particular gloss banding effects, by means of a printing module, a hardening unit and a medium feeder, wherein the printing module provides printed lines with a line width B in a print scan direction, whose ends forming the line margin define a printing texture, and wherein the hardening unit provides essentially completely hardened lines with a line width H, whose ends forming the line margin define a wet/dry texture, wherein a printed line of a printing scan partially, but not fully, overlaps with the hardened line of a hardening scan, in a print scan direction.

18 Claims, 4 Drawing Sheets

(51) Int. Cl.
*B41J 11/00* (2006.01)
*B41M 5/00* (2006.01)
*B41M 7/00* (2006.01)

(52) U.S. Cl.
CPC ..... *B41M 5/00* (2013.01); *B41M 7/009* (2013.01); *B41M 7/0081* (2013.01)

(58) Field of Classification Search
USPC ..... 347/102
See application file for complete search history.

(56) References Cited

U.S. PATENT DOCUMENTS 8,240,840 B2 * 8/2012 Usuda ..... B41J 11/002 347/102
8,567,936 B2 * 10/2013 Edwards ..... B41J 11/002 347/102
8,602,548 B2 * 12/2013 Miyabayashi ..... B41J 11/0015 347/101
8,950,847 B2 * 2/2015 Seki ..... B41J 2/16526 347/33
9,028,057 B2 * 5/2015 Miyabayashi ..... B41J 11/0015 347/102
2004/0114016 A1 * 6/2004 Yokoyama ..... B41J 11/002 347/102
2006/0066703 A1 * 3/2006 Kadomatsu ..... B41J 11/007 347/102
2007/0109382 A1 * 5/2007 Lafleche ..... B41J 11/0015 347/102
2008/0174648 A1 * 7/2008 Nakano ..... B41J 11/002 347/102
2008/0218574 A1 * 9/2008 Furuno ..... B41J 2/2146 347/100
2009/0207223 A1 * 8/2009 Cofler ..... B41J 3/28 347/102
2009/0207224 A1 * 8/2009 Cofler ..... B41J 3/28 347/102
2010/0141724 A1 * 6/2010 Nakajima ..... B41J 11/002 347/102
2010/0259589 A1 * 10/2010 Barry ..... B41J 11/002 347/102
2011/0242243 A1 * 10/2011 Miyabayashi ..... B41J 11/0015 347/102
2012/0281049 A1 * 11/2012 Kachi ..... B41J 11/002 347/102

* cited by examiner

METHOD FOR REDUCING BANDING EFFECTS

The present invention relates to a method for reducing disadvantageous banding effects, in particular gloss banding effects, in printed images that are produced using an inkjet printer.

As is well known, banding effects are visible impairments in the quality of an image and are characterized in that in the printed image, abrupt or continuous transitions of image attributes, such as for example gloss or color, become visible and annoyingly noticeable, when no transitions of this kind are desired.

The causes of such transitions can be of a varied nature and can in certain cases be attributed concretely to specific quality parameters such as for example inhomogeneity of the drop shape or inhomogeneity of the ink application or the inhomogeneity of the drop placement, but in other cases however are subject to the interaction of several quality parameters.

Hereinafter, some causes will be explored that can result in the above-mentioned transitions. It is known that the drop shape of the ink drop that can be achieved on a medium is not exactly circular but that it is among others dependent on the direction of printing. The drop shape dependent on the printing direction is most pronounced immediately after arriving upon the medium and can over the course of time lose at least partly its character depending on the printing direction due to the wetting behavior of the ink drops. The printing direction dependent drop shape of the ink drop can be traced to its flight trajectory, so that in a scanner method for example the arrival of the ink drops on the medium results in a drop shape that is nearly elliptical in the direction of printing and nearly wedge-shaped in height, whose side running towards the tip points against the direction of printing.

When an image is printed in a bidirectional single-scan process, the gloss banding effect becomes particularly prominent.

A single scan process is understood to mean for example a process in which a scanning printing module comprising at least one printhead travels in a scanning movement merely once, i.e. in a single pass over a line of a medium to be printed, whilst this line is being printed, in such a way that in the course of the single coating, the printing of the line is completed.

For example, a printing module comprising at least one printhead travels in a bidirectional single-scan process in a first printing run in one scanning direction merely once over a line, during which the latter is printed. When reaching the end of the line, the medium to be printed is shifted by a line width in the medium's direction of travel. In a second printing run, the printing module travels in a second scanning direction opposite to the first scanning direction over a further line, during which the latter is printed. Subsequently, the medium to be printed is shifted by a further line width in the medium's direction of travel. To print further lines, it is possible to proceed in a similar way to the above-mentioned steps.

In the case of an image printed in this manner, the banding effect (also called streaking effect) is particularly pronounced since lines printed in opposed directions in turn have drops with opposed nearly wedge-shaped drop shapes which seen in one perspective reflect the light differently, so that gloss transitions between neighboring lines appear abrupt.

As a rule, determining the time interval between printing and drying is critical for the desired degree of gloss or mattness, respectively, of an image or of part of an image, respectively, since the time interval among others determines whether and to what extent the ink drops can wet the surface of the medium.

If ink drops are completely dried or hardened, respectively, immediately after the printing, they don't have time to move away from one another or move closer to one another (depending on the wetting behavior: no wetting, partial wetting, complete wetting), so that such a process results in the image appearing matt or grainy, respectively.

If on the other hand a glossy image is desired, it is basically possible in the case of media to be printed that have a relatively small surface energy to increase the time between the printing and the hardening, so that the printed ink drops have more time to disperse and to wet the surface.

It is known that the wetting behavior of an ink drop follows from the Young equation:

$$\alpha = \arccos\left[(\sigma_S - \sigma_{S,L}/\sigma_L)\right], \text{ where}$$

$\sigma_S$ is the surface energy of the substrate $\sigma_{S,L}$ is the interfacial tension between ink and medium $\sigma_L$ is the surface tension of the ink $\alpha$ is the edge angle (contact angle, wetting angle)

The smaller the surface energy of a medium, the greater is its wetting capacity and the less "spherical" is the shape of the ink drops.

Banding effects can occur not only as gloss transitions between neighboring lines printed in opposite directions but can also occur in one and the same line as continuous gloss transitions.

This can be the case for example if in one printing run, when the printing module is scanning from one starting point towards an end point of a line, ink drops are expelled out of the printing module and the printed ink drops are not hardened completely immediately after contacting the medium, but only in a second printing run opposite to the first printing run, in which the printing module is driven back from the end position towards the starting position of the same line and the ink drops printed in the previous printing run are hardened with a drying or hardening unit, respectively. Those ink drops that were printed at the starting position have considerably more time to move away from one another than those ink drops that were printed shortly before the end point on the medium, so that a continuous gloss banding effect occurs in one and the same line in such a way that in this case, places close to the starting position appear more glossy than those close to the end position.

It is known that it is advantageous to keep the time intervals between printing and drying at least approximately constant in order to be able to suppress such continuous banding effects in one and the same line of an image.

In the single-pass technique, maintaining a constant time interval for minimizing continuous gloss banding effects is technically easy to achieve, for example by placing a drying or hardening unit, respectively, downstream of a printing module in the travelling direction of the medium, so that for each point of the medium the same time interval can be maintained between printing and drying or hardening, respectively.

A single-pass printer is understood to mean a printer in which the medium is moved continuously in an operating mode and a printhead sees the medium a single time, with the printheads not being operated according to the known scanning method but are placed essentially in a stationary manner.

By contrast thereto, maintaining constant time intervals in the scanning method—should glossy pictures be desired—is technically more difficult to achieve.

It is known for multi-scan processes that banding effects that can be traced to an inhomogeneity of the drop shape can be partly reduced in that a printing module is driven several times over the same line from more than one direction (e.g. bi-directionally), so that a line of the image is built-up step-by-step in such as way that the ink drops are applied in an interleaved manner according to a particular computational algorithm. In this connection, the ink drops can be dried immediately or not immediately after printing, depending on the desired gloss effect.

If the image build-up of each line is performed merely one-directionally, i.e. from the same direction, the banding effects previously mentioned that result from the inhomogeneity of the drop form can be at least partly avoided preventatively already in advance. However, such processes take place at the cost of productivity.

Banding effects, however, can also occur regardless of the inhomogeneity of the drop shape, which depends among others on the direction of printing and on the wetting behavior over time, on the grounds of the inhomogeneity of the drop placement. The inhomogeneity of the drop placement can for example arise because of an inaccurate guiding of the medium and/or of the printing module and/or can however also be traced to the drying or hardening steps, respectively, already performed.

An inhomogeneity of the drop placement caused by drying or hardening steps, respectively, can occur in the case of heat-sensitive media, if for example a multi-scan technique is used, in the course of which one and the same point of a line of the medium to be printed undergoes several printing steps and several drying or hardening steps, respectively.

Depending on the type of heat-sensitive media used, they will tend to either expand or shrink after a drying or hardening step, respectively.

If a printhead for example travels several times over the same line of a heat-sensitive medium in two directions, wherein in a first printing run the printing module, for example with a mercury lamp generating UV light chasing it upstream in the scanning direction as drying or hardening unit, respectively, is driven from a starting position towards an end position whilst the medium is printed and the printed drops are hardened immediately after the printing by means of the drying or hardening unit, respectively, the medium is exposed to the heat discharge from the drying or hardening unit, respectively. Following the single heating of the medium, the latter can already expand or shrink. Shrinking can occur for example if it contains a solvent or water and, because of the heating, at least partly evaporates. If the printing module drives in a second printing run back to the starting position, the ink drops can no longer be printed on the intended positions.

Following the expansion or shrinking effects, which can be reversible or irreversible, gloss transition and/or color transitions can occur in the image, which lead to banding effects. It is possible to say that heat-sensitive media strongly tend to banding effects.

The exact feeding of the medium and/or of the carriage is still very important for the accuracy of the drop placement, since a certain overlap of the printed lines in their marginal areas can for example cause a banding due to a double application of ink.

Furthermore, an inhomogeneity of the drop placement can occur if for example dried-up or liquid ink residues are present in the vicinity of the nozzle openings of a printhead of a printing module, so that the affected nozzle openings could be at least partly closed off and these ink residues could stand in the way of the ink drop trajectory, so that the expelling process is impaired. As a consequence thereof, the ink drops can for example no longer contact the desired positions of the medium to be printed. If there are dried-up ink residues in the area of the nozzle openings, the affected nozzle can produce a skewed jet or fail completely.

The inhomogeneity of the drop placement can, as explained above, result in an inhomogeneity of the ink application, which in turn causes a color banding effect. The inhomogeneity of the ink application can also be nozzle-specific due to a construction of the nozzles that is not exactly identical, which involuntarily causes drops of different sizes to be expelled.

It would be desirable to have a method with which banding effects, in particular gloss banding effects, can be at least partly reduced in printed images, regardless of the type of medium and independently of the used printing scanning method, whether one-directional or bi-directional.

The present invention has the task of proposing a method for a printer with which the mentioned banding effects can be at least partly reduced, so that the quality of the image can be increased.

The task is solved by proceeding according to the inventive method with a printer working with a scanning printing module, with a scanning drying or hardening unit, respectively, and with a medium feeder, according to claim 1. The dependent claims described preferred variant embodiments of the present inventive method.

In the process according to the invention, the banding effects in images, in particular gloss banding effects, can be at least partly reduced in that a method is provided wherein a scanning printing module provides printed lines with a line width B, whose ends forming the line margin define a printing texture, and a scanning drying or hardening unit, respectively, provides lines essentially completely dried or hardened, respectively, with a line width H, whose ends forming the line margin define a wet/dry texture, wherein a printed line of a printing scan and a hardened line of a hardening scan are formed overlapping yet without running congruently.

At this stage, some terms used in this description will be defined.

When in the frame of this description mention is made of a printing texture, this is understood as the transition between the not printed area of the medium and the printed area of a printed line.

When in the frame of this description mention is made of a wet/dry texture, this is understood as the transition between the printed area of a printed line and the hardened area of a hardened line.

When in the frame of this invention mention is made of a wet/pinning texture, this is understood as the transition between the printed area of a printed line and the pinned area of a pinned line.

When in the frame of this invention mention is made of pinning, this is understood as the partial yet not complete drying or hardening, respectively, of the printed drops.

When in the frame of this invention mention is made of "drying or hardening", respectively, this is understood to mean that the printed ink drops are essentially completely dried or hardened, respectively.

"Scan" in the frame of the present invention is understood to be the travelling of a certain scanning stretch with the printing module or with the drying or hardening unit, respectively.

It has surprisingly been shown that through the idea of printing and drying or hardening, respectively, an image as described above in such a way that a printed line of a printing scan and a hardened line of a hardening scan are formed overlapping yet without running congruently, whereby at least one of the two wet/dry textures of a hardened line of a hardening scan, as compared to one of the two wet/dry textures of a printed line of a printing scan, are formed running only partly congruently, or running in crossing manner or running non congruently, the image has a less pronounced banding effect than when a printed line of a printing scan and a hardened line of a hardening scan are formed running congruently, wherein both wet/dry textures of a hardened line of a hardening scan as compared to both printing textures of a printed line of a printing scan could be formed running congruently.

The inventor cannot say with absolute certainty why by means of the procedure described above the banding effects can be partly reduced. It can however be speculated that achieving the different textures and increasing the number and type of transitions of the image attributes exert a synergistic effect in relation to the reduction of the banding effect, whereby the image quality can be improved.

The invention will be described hereinafter in detail on the basis of the figures and by way of example.

Figure 1:
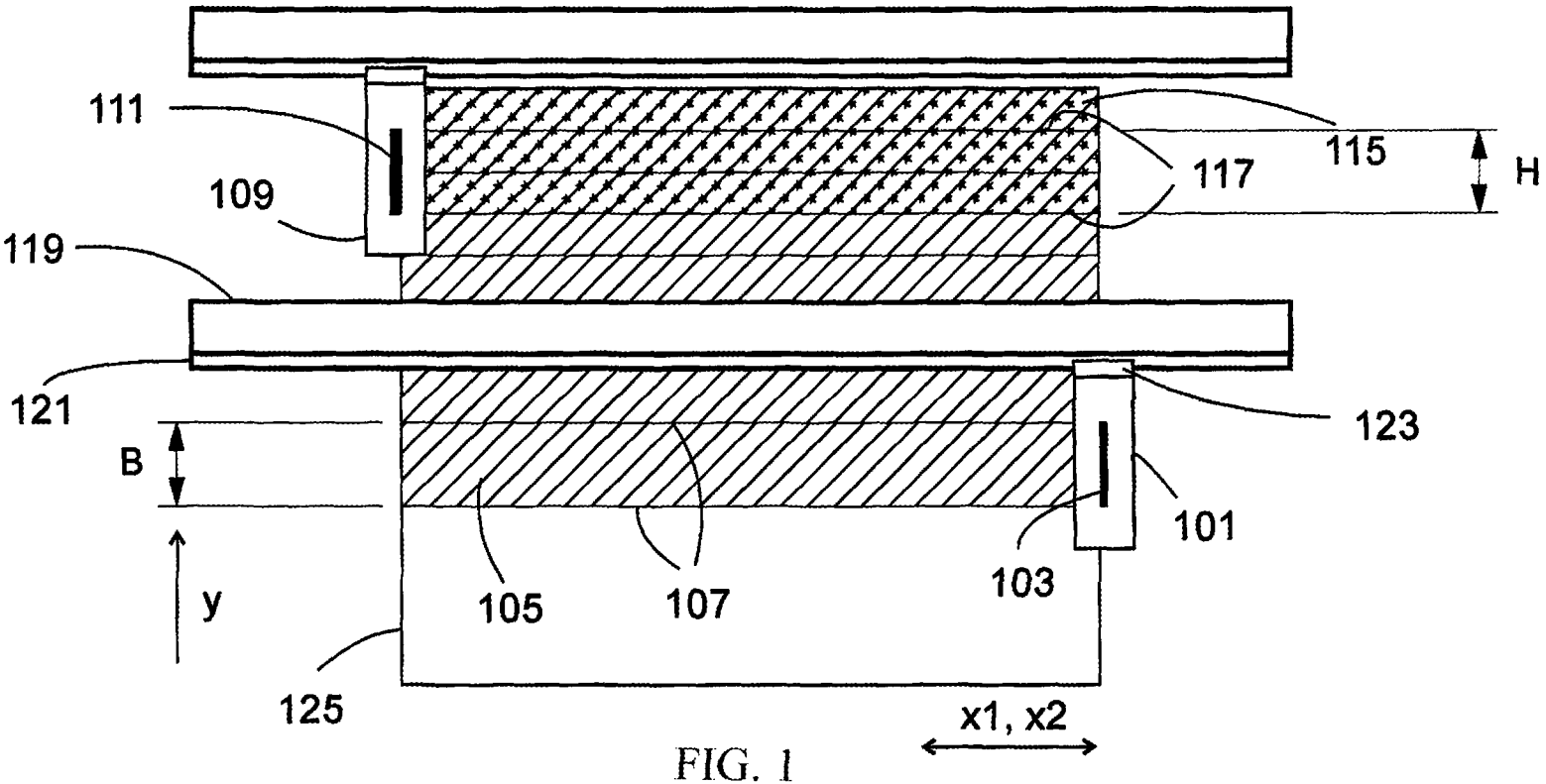
FIG. 1 shows a schematic representation of an image produced with a preferred embodiment of the inventive method.

FIG. 1 shows an image produced using a preferred embodiment of the inventive method. The image shows a printer working with a scanning printing module 101, a scanning drying or hardening unit, respectively, 109 and a medium feeder. The printing module 101 provided printed lines 105 with a line width B, whose ends forming the line margin define a printing texture 107, and lines 115 essentially completely dried or hardened, respectively, using a scanning drying or hardening unit, respectively, 109 with a line width H were provided whose ends forming the line margin define a wet/dry texture 117.

In FIG. 1, the printing module 101 is guided by way of example using a linear guide system 119, said linear guide system 119 having a guide rail 121 and at least one printing module 101 provided with guiding elements 123 and that can be guided in its movement in the direction of the guide rail 121.

The image shown in FIG. 1 can be produced for example as follows:

In one method step, the printing module 101 is scanned once over the medium 125 in a scanning direction X1 and a line 105 is printed during which the medium 125 is not moved. Once the line 105 has finished being printed, the scanning printing module 101 is braked and stopped and the medium 125 to be printed is moved further perpendicular to the scanning direction in a feeding direction y by one line-width B. In a further method step, the printing module 101 is driven in a scanning direction X2 opposite to the previous scanning direction X1 and a further line 105 is printed, during which the medium 125 is not moved. In order to print additional lines 105, it is possible to proceed in a manner similar to the previously mentioned steps. In doing so, printed lines 105 with a line-width B are provided, whose ends forming the line margin define a printing texture 107. The lines 105 with a line width B printed according to the previously mentioned method steps by a scanning drying or hardening unit, respectively, 109 that for example placed downstream from the scanning printing module 101 in the feeding direction of the medium 125 travels in scanning fashion in such a way that during a printing scan, printed ink drops are essentially completely dried or hardened, respectively. In this connection, essentially completely dried or hardened lines, respectively, 107, which can have a line width H, are provided whose ends forming the line margin define a wet/dry texture 117. In this example, the first dried or hardened line, respectively, has a different line width than the dried or hardened line, respectively, 115 with a line width H that is provided in the second hardening run. A printed line 105 of a printing scan and a hardened line 115 of a hardening scan are thus formed overlapping yet without running congruently.

In the inventive method for reducing banding effects in images, in particular gloss banding effects, a printer works with a scanning printing module 101, a scanning drying or hardening unit, respectively, 109 and a medium feeder, wherein lines 105 are provided that are printed with the scanning printing module 101 with a line width B, whose ends forming the line margin define a printing texture 107, and lines 115 with a line width H, whose ends forming the line margin define a wet/dry texture 117, are provided which are essentially completely dried or hardened, respectively, with a scanning drying or hardening unit, respectively, 109.

According to the invention, in this case a printed line 105 of a printing scan and a hardened line 115 of a hardening scan are formed overlapping yet without running congruently.

The printing texture 107 can, in a preferred embodiment of the method, be formed running parallel in relation to the scanning direction of the printing module 101 and the wet/dry texture 117 can be formed running parallel or not parallel in relation to the printing texture 107.

A wet/dry texture 117, that has been formed running parallel in relation to the printing texture 107, is shown for example in FIG. 1. The drying or hardening unit, respectively, 109 in this case can dry or harden, respectively, in an active pass (hardening run) simultaneously drops printed from one side to the next side, which are printed in the frame of at least two different active passes (printing runs) of the printing module 101. There are therefore drops printed in the context of a pass of the printing module 101 that are dried or hardened, respectively, in the context of different passes of the drying or hardening unit, respectively 109.

Figure 2:
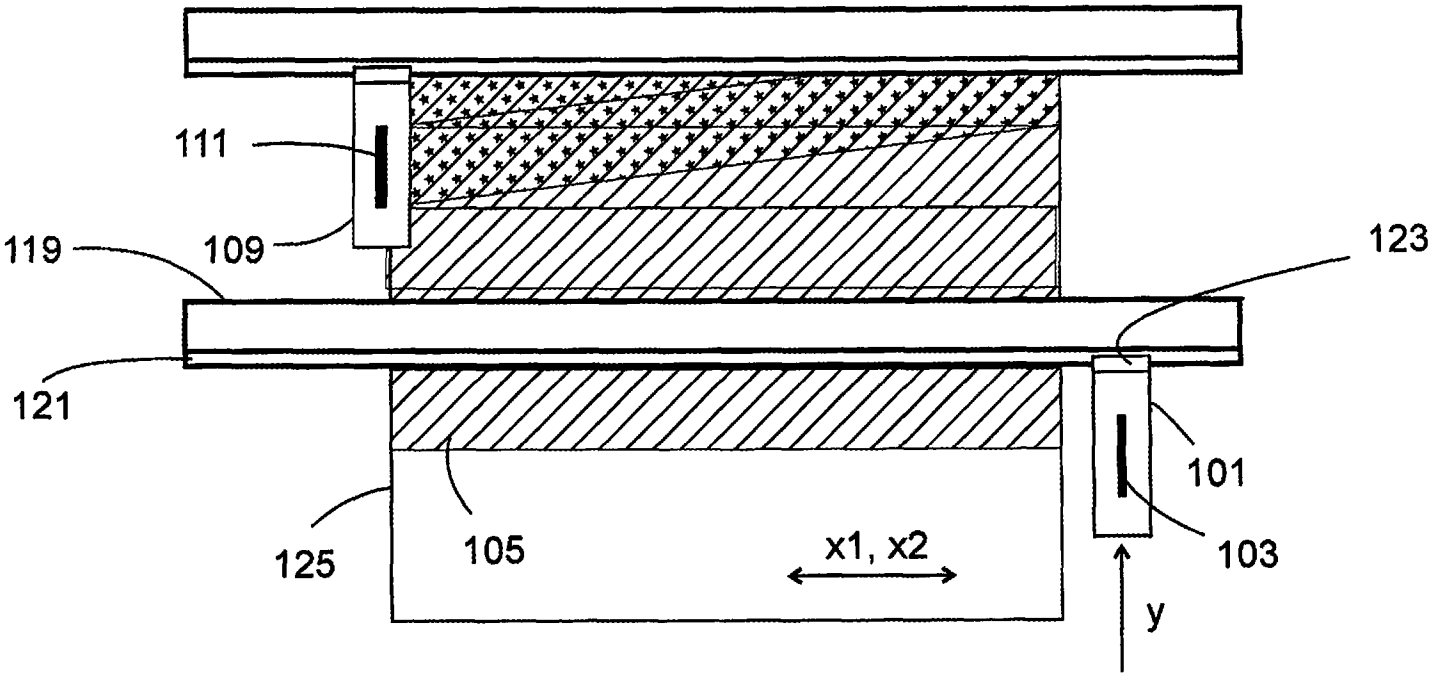
FIG. 2 shows a schematic representation of an image produced with another preferred embodiment of the inventive method.

FIG. 2 shows a printed image with a wet/dry texture 117 that has been formed for example non parallel in relation to the printing texture 107 and which does not intersect the printing texture 107.

Figure 3:
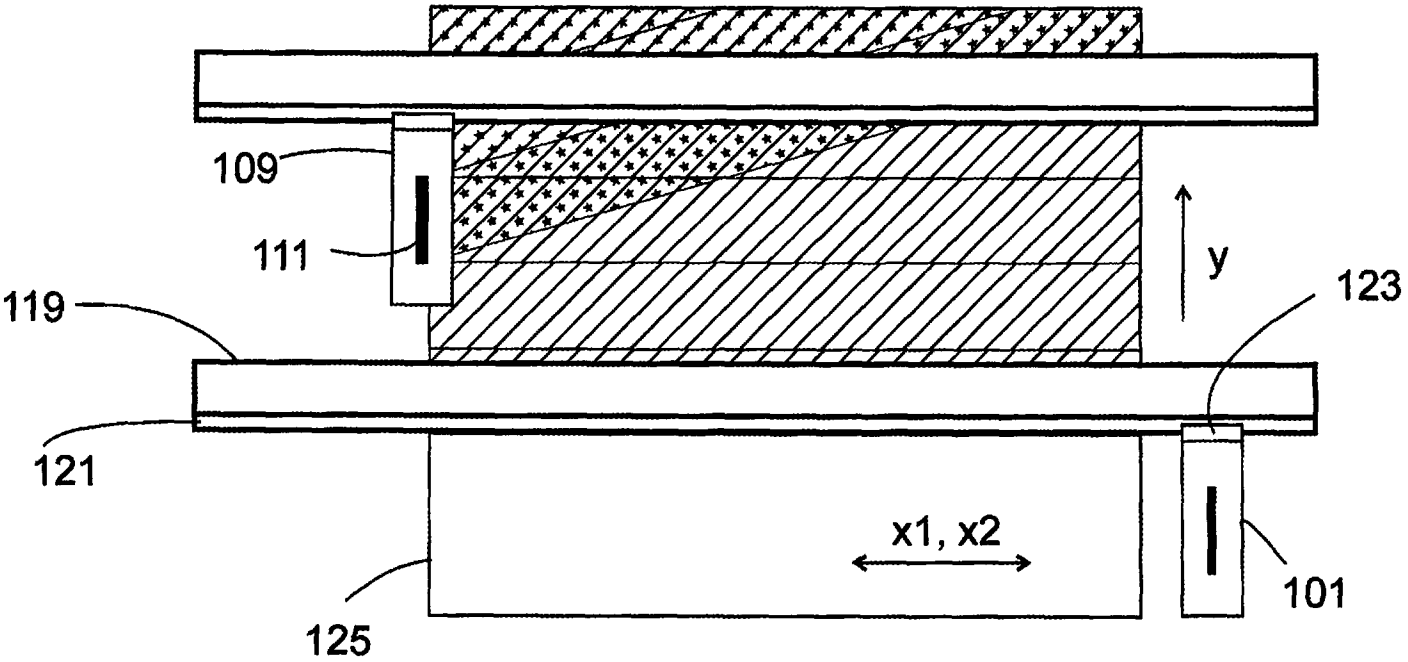
FIG. 3 shows a schematic representation of an image produced with another preferred embodiment of the inventive method.

The wet/dry texture 117 formed not running parallel in relation to the printing texture 107 can in a preferred embodiment of the invention cross one or several printing textures 107. Such an example is shown in FIG. 3, in which a wet/dry texture 117 has been provided that intersects at least one printing texture 107.

In a further preferred embodiment of the method, at least a second wet/dry texture 117 is formed with the scanning drying or hardening unit, respectively, 109, which is formed running parallel or running non parallel in relation to the first wet/dry texture 117.

In the method, the scanning drying or hardening unit, respectively, 109 can be spaced away in relation to the scanning printing module 101 and placed downstream in the feeding direction of the medium to travel in scanning fashion. This is particularly advantageous when heat-sensitive media 125 are used, since the latter are not printed in the immediate vicinity of the effective range of the drying or hardening unit, respectively, 101.

The drying or hardening unit, respectively, 109 can comprise at least one UV diode array or at least one UV lamp, respectively, 111, with which the drying or hardening, respectively, can occur.

The speed of displacement of the scanning drying or hardening unit, respectively, 109 can be maintained partly constant or variable at least during the drying or hardening, respectively.

The scanning speed of the drying or hardening unit, respectively, 109 and the feeding speed of the medium 125, during the drying or hardening, respectively, of a printed line 105, can at least part of the time be simultaneously greater than zero.

In a preferred embodiment of the inventive method, for different printed locations of the medium 125, a time interval between printing and drying is chosen in such a manner that the latter is maintained nearly constant or not constant.

The UV diode array or the UV lamp can comprise several radiation sources that can be controlled independently of one another.

In a particularly preferred embodiment of the inventive method, the printer can work with a scanning printing module 101 comprising at least one pinning device 104 with at least one UV-LED array, which at least one pinning device 104 is placed respectively at the ends of the printing module 101 opposite to the direction of scanning, wherein lines 105 printed using the scanning printing module 101 with a line width B are provided, whose ends forming the line margin define a printing texture 107, and wherein pinned lines 116 with line width P are provided following immediately in the same printing scan, whose ends forming the line margin define a pinning texture 127, wherein a printed line 105 of a printing scan and a pinned line 116 of a pinning scan are formed overlapping yet without running congruently.

The printed lines 105 and/or the hardened lines 115 and/or the pinned lines 116 can have respectively constant or variable widths.

Figure 4:
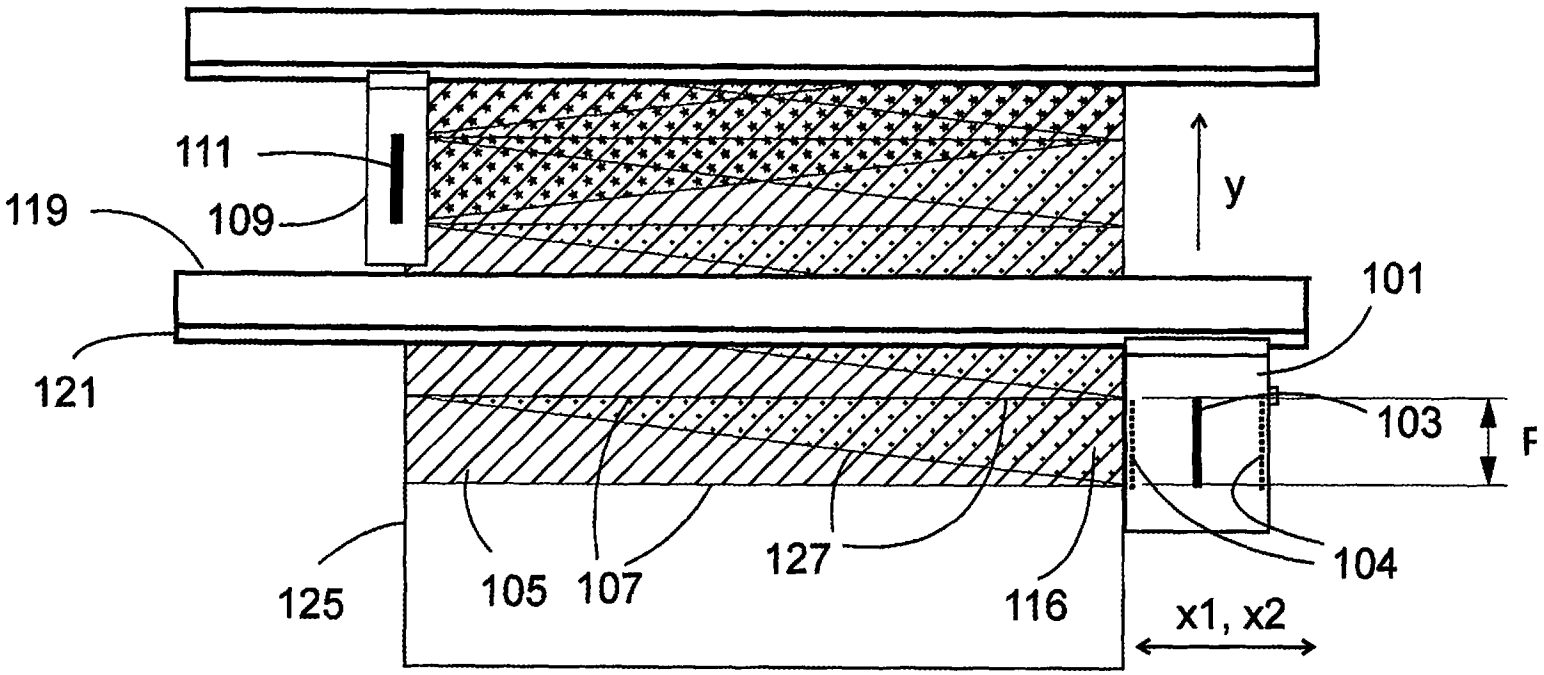
FIG. 4 shows a schematic representation of a preferred embodiment of the inventive method with an image produced with a pinning device and a drying or hardening unit, respectively.

An image that has been produced according to this preferred embodiment is shown in FIG. 4, in which the pinned lines 116 have a variable line width B at different places along the scanning direction X1.

In the inventive printer, the printer comprises a scanning printing module 101 and a positioning device which is designed for being able to move a medium 125 in a feeding direction and the scanning printing module 101 in a scanning direction perpendicular to the feeding direction, wherein the printing module 101 comprises at least one printhead 103 with at least one row of nozzles and the inkjet printer comprises a control unit for performing at least one inventive method.

The drying or hardening unit, respectively, 109 can be placed downstream of the scanning printing module 101 in the travelling direction of the medium 125.

The printer can be an inkjet printer.

It should be pointed out that the reference signs for the elements in one figure are transferable to the some elements in another figure and vice-versa.

Finally, it should be pointed out for the sake of good order that for the sake of a better understanding, the printer and its components are represented in the figures not to scale and/or in enlarged size and/or in reduced size.

What is claimed is:

1. Method for reducing banding effects in images, in particular gloss banding effects, by means of a printer that works with a printing module, a hardening unit, and a medium feeder, the method comprising the following steps:

providing, during a printing scan of the printing module, printed lines extending in a print scan direction and having a first line width, whose ends forming a line margin define a printing texture, and during a hardening scan of the hardening unit, hardening the printed lines to form hardened lines with a second line width, whose ends forming the line margin define a wet/dry texture, wherein a printed line of a printing scan partially, but not completely overlaps with a hardened line of a hardening scan in the print scan direction.

2. Method according to claim 1, wherein the printing texture is formed running parallel in relation to the print scan direction and the wet/dry texture is formed running parallel or not parallel in relation to the print scan texture.

3. Method according to claim 2, wherein the wet/dry texture is formed not running parallel in relation to the printing texture, wherein the wet/dry texture furthermore crosses one or several printing textures.

4. Method according to claim 1, wherein the hardening unit is spaced away in relation to the scanning printing module and placed downstream in the feeding direction of the medium.

5. Method according to claim 1, wherein the hardening unit comprises at least one UV diode array or at least one UV lamp, with which a drying or hardening occurs.

6. Method according to claim 1, wherein the speed of displacement of the hardening unit is maintained partly constant or variable at least during hardening.

7. Method according to claim 1, wherein the scanning speed of the hardening unit and the feeding speed of the medium, during the hardening of a printed line, can at least part of the time simultaneously be greater than zero.

8. Method according to claim 1, wherein for different printed locations of the medium, a time interval between printing and drying is chosen in such a manner that the time interval is maintained nearly constant or not constant.

9. Method according to claim 5, wherein the UV diode array or the UV lamp comprises several radiation sources that can be controlled independently of one another.

10. Method according to claim 1, characterized in that the printer works with a printing module comprising at least one pinning device with at least one UV-LED array, wherein the at least one pinning device is placed at the ends of the printing module with respect to the print scan direction, the method further comprising the step:

pinning the printed lines to form pinned lines with a third line width immediately following providing printed lines and in the same printing scan, wherein ends of the pinned lines forming the line margin define a pinning texture, wherein a printed line of a printing scan partially, but not completely overlaps with a pinned line of a pinning scan in the print scan direction.

11. Method according to claim 1, wherein with the hardening unit at least a second wet/dry texture is formed that is formed running parallel or not parallel in relation to the first wet/dry texture.

12. Method according to claim 1, wherein the printed lines having the first width and/or the hardened lines having the second width and/or the pinned lines having the third width each have constant or variable widths.

13. Method according to claim 1, characterized in that the printer is an inkjet printer.

14. Inkjet printer comprising a printing module and a positioning device which is designed for being able to move a medium in a feeding direction and the printing module in a print scan direction perpendicular to the feeding direction, wherein the printing module comprises at least one printhead with at least one row of nozzles and the inkjet printer comprises a hardening unit, wherein the inkjet printer has a control unit for performing a method according to claim 1.

15. Inkjet printer according to claim 14, wherein the hardening unit is placed downstream of the printing module in the travelling direction of the medium.

16. Method for reducing banding effects in images printed on a medium by means of a printer comprising a printing unit, a hardening unit, and a medium feeder for moving the medium through the printer in a medium feed direction, the method comprising the following steps:

operating the printing unit to form a printed line in a print-scan direction which is perpendicular to the medium feed direction, said printed line having a first width and a first length in the print-scan direction; and operating the hardening unit to form a hardened line having a second width and a second length, wherein said second width of said hardened line partially but not fully overlaps said first width of said printed line over a portion of said second length.

17. Method according to claim 1, wherein only a portion of the printed line, said portion corresponding to a first reduced width less than the first line width, is hardened during the hardening scan.

18. Method according to claim 1, wherein only a portion of the dried or hardened line, said portion corresponding to a second reduced width less than the second line width, is superimposed with a given one of the printed lines.

* * * * *